US006607047B1

(12) United States Patent
Swadi et al.

(10) Patent No.: US 6,607,047 B1
(45) **Date of Patent: *Aug. 19, 2003**

(54) EARTH-BORING BIT WITH WEAR-RESISTANT SHIRTTAIL

(75) Inventors: Mohammed Swadi, The Woodland, TX (US); Brian Wiesner, Edmond, OK (US); Greg Van Klompenburg, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/259,889

(22) Filed: Apr. 1, 1999

Related U.S. Application Data

(63) Continuation of application No. 08/854,200, filed on May 9, 1997, now Pat. No. 5,890,550.

(51) Int. Cl.[7] ..... E21B 10/50
(52) U.S. Cl. ..... 175/374; 175/408
(58) Field of Search ..... 175/374, 408

(56) References Cited

U.S. PATENT DOCUMENTS 3,628,616 A 12/1971 Nelson et al.
4,591,008 A 5/1986 Oliver
5,074,367 A 12/1991 Estes
5,145,016 A 9/1992 Estes
5,201,376 A 4/1993 Williams
5,289,889 A * 3/1994 Gearhart et al. ..... 175/325.5
5,415,243 A * 5/1995 Lyon et al. ..... 175/331
5,421,423 A 6/1995 Huffstutler
5,553,681 A 9/1996 Huffstutler et al.
5,709,278 A 1/1998 Crawford
5,722,497 A 3/1998 Gum et al.
5,755,297 A 5/1998 Young et al.
5,755,298 A 5/1998 Langford, Jr. et al.
5,755,301 A 5/1998 Love et al.
5,890,550 A 4/1999 Swadi et al.
6,116,357 A * 9/2000 Wagoner et al. ..... 175/228
6,173,797 B1 * 1/2001 Dykstra et al. ..... 175/325.2
2001/0030067 A1 * 10/2001 Evans et al. ..... 175/374
2002/0092684 A1 * 7/2002 Singh et al. ..... 175/339

* cited by examiner

*Primary Examiner*—Hoang Dang
(74) *Attorney, Agent, or Firm*—Bracewell & Patterson, L.L.P.

(57) ABSTRACT

An earth-boring bit has a bit body that is threaded at one end for connection into a drill string. At least one cantilevered bearing shaft depends inwardly and downwardly from the bit body. A cutter is mounted for rotation on each bearing shaft and includes a plurality of cutting elements arranged in generally circumferential rows. At least one wear-resistant element is secured to the bit body between the lower end of the bit body and the threaded end, the wear-resistant element being elongate or generally oblong in cross-section.

16 Claims, 2 Drawing Sheets

EARTH-BORING BIT WITH WEAR-RESISTANT SHIRTTAIL

This application is a continuation of application Ser. No. 08/854,200, filed May 9, 1997, entitled Earth-Boring Bit With Wear-Resistant Shirttail, now U.S. Pat. No. 5,890,550.

BACKGROUND OF THE INVENTION

1. Field of the Invention

The present invention relates to earth-boring bits of the rolling cutter variety. Specifically, the present invention relates to improving the wear resistance of earth-boring bits.

2. Background Information

The success of rotary drilling enabled the discovery of deep oil and gas reserves. The rotary rock bit was an important invention that made that success possible. Only soft formations could be commercially penetrated but with the earlier drag bit. The original rolling-cone rock bit, invented by Howard R. Hughes, U.S. Pat. No. 939,759, drilled the hard caprock at the Spindletop field, near Beaumont Texas, with relative ease.

That venerable invention, within the first decade of this century, could drill a scant fraction of the depth and speed of modern rotary rock bits. If the original Hughes bit drilled for hours, the modern bit drills for days. Bits today often drill for miles. Many individual improvements have contributed to the impressive overall improvement in the performance of rock bits.

Earth-boring bits typically are secured to a drill string, which is rotated from the surface. Drilling fluid or mud is pumped down the hollow drill string and out of the bit. The drilling mud cools and lubricates the bit as it rotates and carries cuttings generated by the bit to the surface.

Rolling-cone earth-boring bits generally employ cutting elements on the cutters to induce high contact stresses in the formation being drilled as the cutters roll over the bottom of the borehole during drilling operation. These stresses cause the rock to fail, resulting in disintegration and penetration of the formation material being drilled.

Operating in the harsh down hole environment, the components of earth-boring bits are subjected to many forms of wear. Among the most common forms of wear is abrasive wear caused by contact with abrasive rock formation materials. Moreover, the drilling mud, laden with rock chips or cuttings, is a very effective abrasive slurry.

Many wear-resistant treatments are applied to the various components of the rock bit. Among the most prevalent is the application of a welded-on wear-resistant material or "hardfacing." This material can be applied to many surfaces of the rock bit, including the cutting elements. Commonly assigned U.S. Pat. No. 3,158,214 to Wisler et al., discloses application of hardfacing to the "shirttail" of the bit, a portion of the bit body immediately above the cutters that contacts the sidewall of the borehole and is subject to great abrasive wear. Another solution applied to the shirttail region is a plurality of wear-resistant inserts, similar to those used in the cutters, secured by interference fit in the shirttail. Sometimes, these inserts are designed to cut or actively engage the sidewall of the borehole to act as stabilizers in addition to wear pads.

A need exists, therefore, for earth-boring bits of the rolling-cutter variety having improved means for resisting abrasive wear.

SUMMARY OF THE INVENTION

It is a general object of the present invention to provide an earth-boring bit of the rolling cutter variety having an improved wear-resistant treatment of the shirttail.

This and other objects of the present invention are accomplished by providing an earth-boring bit having a bit body that is threaded at one end for connection into a drill string. At least one cantilevered bearing shaft depends inwardly and downwardly from the bit body. A cutter is mounted for rotation on each bearing shaft and includes a plurality of cutting elements arranged in generally circumferential rows. At least one wear-resistant element secured to the bit body between the lower end of the bit body and the threaded end, the wear-resistant element being elongate or generally oblong in cross-section.

According to the preferred embodiment of the present invention, the bit body comprises at least one bit leg from which the bearing shaft depends. A shoulder is defined on each bit leg below the threaded end of the bit body and a shirttail portion on each bit leg proximal the bearing shaft. The oblong wear-resistant element is secured to the shirttail portion of the bit body between the shirttail and the shoulder.

According to the preferred embodiment of the present invention, the wear-resistant element is formed of hard metal and is secured by interference fit in an aperture in the bit body.

According to the preferred embodiment of the present invention, a plurality of the wear-resistant elements are secured to the bit body between the shoulder and the shirttail, the majority of the wear-resistant elements being secured to the bit body proximal a leading edge of each bit leg.

According to the preferred embodiment of the present invention, the bit has a gage diameter and the wear-resistant elements project from the bit body an amount less than the gage diameter of the bit.

DESCRIPTION OF THE PREFERRED EMBODIMENT

Figure 1:
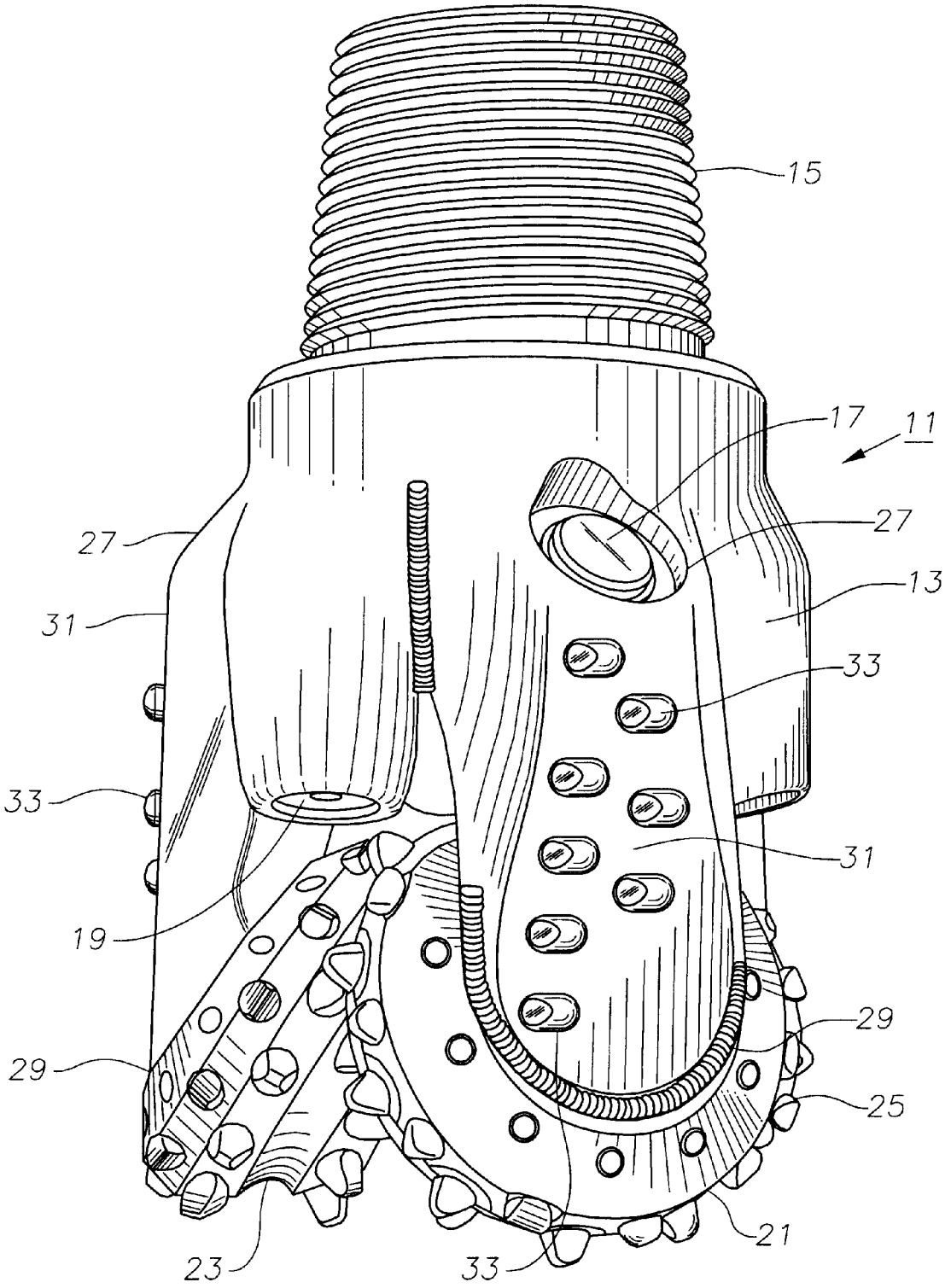
FIG. 1 is a perspective view of an earth-boring bit according to the present invention.

Referring now to the Figures, and particularly to FIG. 1, an earth-boring bit 11 according to the present invention is illustrated. Bit 11 includes a bit body 13, which is threaded at its upper extent 15 for connection into a drill string. Bit body 13 is comprised of three sections or legs, which are individual forgings welded together and machined to form bit body 13. Each leg or section of bit 11 is provided with a lubricant compensator 17, a preferred embodiment of which is disclosed in U.S. Pat. No. 4,276,946, Jul. 7, 1981 to Millsapps. At least one nozzle 19 is provided in bit body 13 to spray drilling fluid from within the drill string to cool and lubricate bit 11 during drilling operation. Three cutters, 21, 23, 25 are rotatably secured to a bearing shaft associated with, and depending inwardly and downwardly from, each leg of bit body 13.

As better seen in FIGS. 2 and 3, a shoulder 27 is defined on each bit leg or section just below the threaded or pin end 15 of body 13. Bit body 13 terminates in a semicircular lower end 29 proximal each cutter and its associated bearing shaft. Region 31 between shoulder 27 and lower end 29 is commonly referred to as the "shirttail." Due to its large surface area and proximity to the sidewall of the borehole in drilling operation, shirttail 31 is exposed to substantial abrasive wear.

To resist this wear, shirttail 31 is provided with a plurality of hard metal, preferably cemented tungsten carbide, inserts or elements 33 secured by interference fit in correspondingly shaped milled slots or apertures in shirttail 33. Alternatively, elements 33 can be brazed into the apertures or otherwise secured to shirttail 31. As described in greater detail below in connection with FIGS. 4 and 5, elements 33 are oblong (or otherwise elongate along one axis) in cross-section.

In FIG. 1, the long axes of elements 33 are oriented transversely or perpendicular to the rotational axis of bit 11. In FIG. 2, the long axes of elements 33 are aligned with the rotational axis of bit 11. In FIG. 3, the long axes of elements 33 are oriented at approximately 45° to the rotational axis of bit 13. In the embodiments of FIGS. 1 and 3, the long axes of elements 33 are at least partially aligned with the direction of rotation of the bit and thus provide extended contact with the sidewall of the borehole. In all embodiments, the majority of elements 33 are disposed proximal the leading edge of shirttail 31 to provide increased wear resistance at this portion of that bears the brunt of the abrasive wear experienced by shirttail 33.

Figure 4:
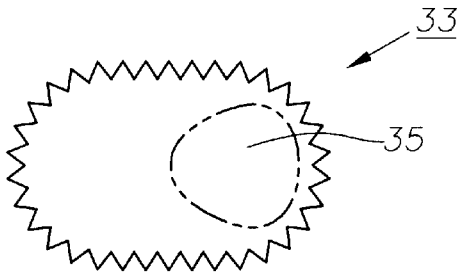
FIG. 4 is an plan view of the wear-resistant insert according to according to the present invention.
Figure 5:
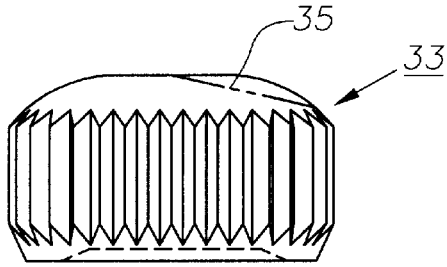
FIG. 5 is an elevation view of the wear-resistant insert according to according to the present invention.

FIGS. 4 and 5 are plan and elevation views, respectively, of oblong element 33 according to the present invention. As can be seen, element 33 is an elongated circle or a rectangle with semicircular ends. This configuration permits element 33 to be secured in a recess or slot that is formed using an end mill. The periphery of element 33 is serrated to facilitate press-fitting into milled slots having a larger range of tolerance.

The uppermost surface of element 33 is enlarged to project above the surface shirttail 31. For the 7⅞" and 8¾" bits shown, the uppermost surface of element 33 projects about 0.090" beyond the surface of shirttail 31. As shown in FIGS. 1 and 3, a flat 35 is optionally provided at the leading end (the end oriented toward the leading edge of shirttail 31) and may be formed of or coated with polycrystalline diamond or other super-hard material. Flat 35 tapers downwardly at an angle of approximately 14° to a level flush with the surface of shirttail 31, when element is press-fit therein. All corners and edges of element 33 are rounded to improve strength and prevent cutting engagement with the sidewall of the borehole.

Figure 2:
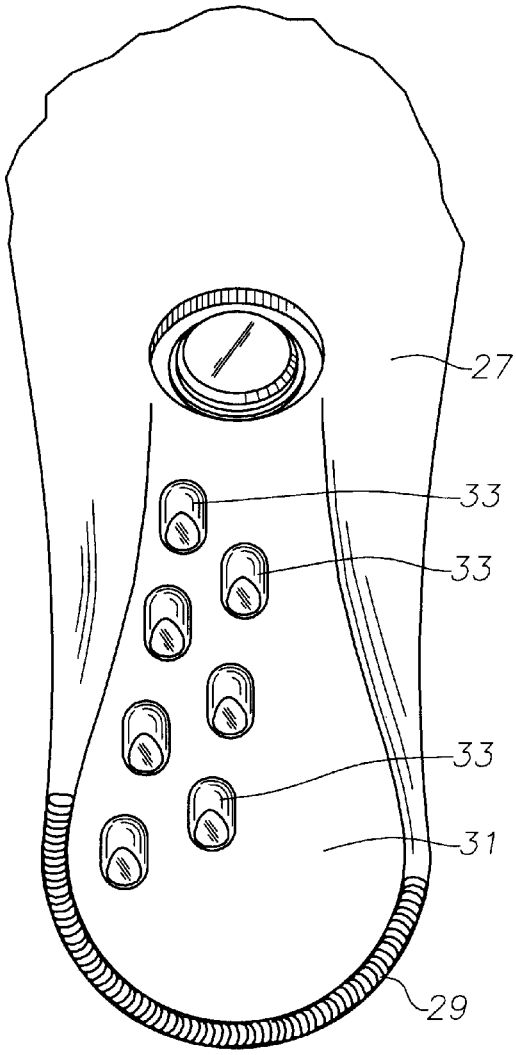
FIG. 2 is a partial view of the shirttail portion of a bit similar to that of FIG. 1.
Figure 3:
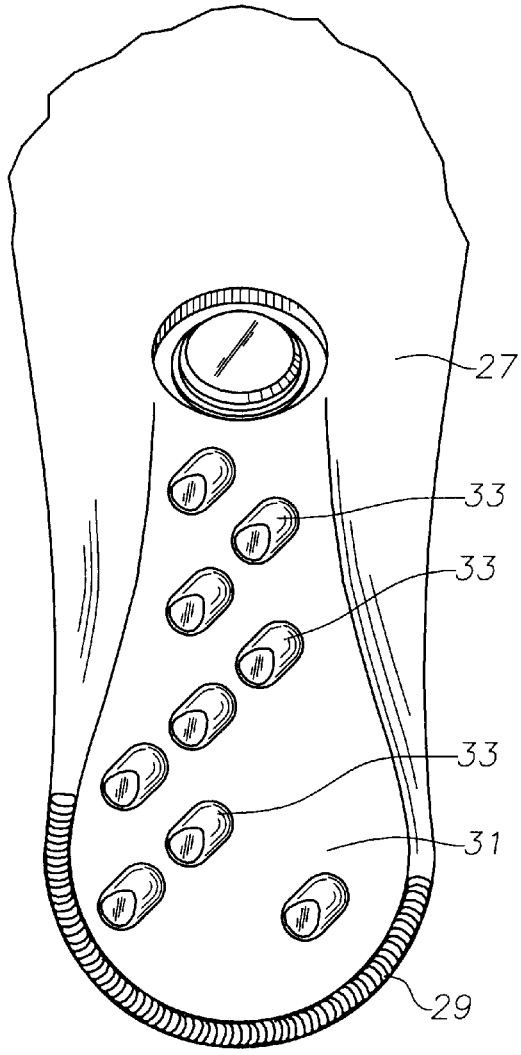
FIG. 3 is a partial view of the shirttail portion of a bit similar to that of FIG. 1.

For the 7⅞" bits of FIGS. 1 and 2 and the 8¾" bit of FIG. 3, element 33 is 0.647 inch in length, 0.397 in width (both including serrations), and 0.395 inch in height (all dimensions are nominal). Because elements 33 are intended as wear-resistant only and not to function as cutting elements or as a stabilizer, elements 33 should project a relatively small amount from shirttail. Preferably, the projection of elements is selected to be at least 0.010 inch under the gage diameter of bit 11.

In operation, as bit 11 is rotated in the borehole, cutters 21, 23, 25 roll and slide over the borehole bottom, disintegrating formation material. Oblong wear-resistant elements 33 protect shirttail 31 against abrasive wear. Because elements 33 do not project to gage diameter, engagement between elements 33 and the sidewall of the borehole is minimized as are friction and gouging or cutting of the sidewall. Thus, the overall wear resistance of bit 11 is improved.

The invention has been described with reference to a preferred embodiment thereof. It is thus not limited, but is susceptible to variation and modification without departing from the scope and spirit of the invention.

We claim:

1. An earth-boring bit comprising:

a bit body with threads at one end for attachment to a drill string, the bit body having an axis of rotation;

at least one bearing shaft depending inwardly and downwardly from an end of the bit body generally opposite the threaded end;

a cutter mounted for rotation on each bearing shaft;

at least one hole formed in an exterior surface of the bit body between the lower end of the bit body and the threaded end, the hole having a sidewall that is generally oblong in a cross-section in a plane perpendicular to a depth of the hole, defining a length greater that is greater than a width, the length running generally parallel with the axis of rotation; and at least one wear resistant element, the wear resistant element mating with and secured within the hole.

2. The earth-boring bit according to claim 1 wherein the bit body comprises:

at least one bit leg, the bearing shaft depending from each bit leg;

a shoulder on each bit leg below the threaded end of the bit body;

a shirttail portion on each bit leg proximal the bearing shaft; and the wear-resistant element is secured to the bit body between the shirttail and the shoulder.

3. The earth-boring bit according to claim 1 wherein the wear-resistant element is formed of hard metal and is secured by interference fit in the hole in the bit body.

4. The earth-boring bit according to claim 1 wherein a plurality of the holes are formed in the bit body between the shoulder and the shirttail, the majority of the holes being proximal a leading edge of each bit leg, each of the holes containing one of the wear-resistant elements.

5. The earth-boring bit according to claim 1 wherein the bit has a gage diameter and the wear-resistant element projects from the bit body an amount less than the gage diameter of the bit.

6. The earth-boring bit according to claim 1 wherein at least a portion of the wear-resistant element is formed of polycrystalline diamond.

7. An earth-boring bit comprising:

a bit body formed of at least one bit section, the bit body being threaded at its upper end for connection to a drill string, the bit body having an axis of rotation;

at least one bearing shaft depending inwardly and downwardly from each bit section of the bit body, each bit section having a shirttail region proximal the bearing shaft;

a cutter mounted for rotation on each bearing shaft; and at least one wear-resistant element secured to the bit body between the shirttail and the threaded end, the wear-resistant element having a bottom and being oblong in a cross-section that is parallel to the bottom, defining two opposite rounded edges through which a long axis extends, the wear-resistant element being oriented so that its long axis is substantially parallel with the axis of rotation.

8. The earth-boring bit according to claim 7 wherein the bit body includes a shoulder proximal the threaded end and the wear-resistant element is secured to the bit body below the shoulder.

9. The earth-boring bit according to claim 7 wherein the wear-resistant element is formed of hard metal and is secured by interference fit in an aperture in the bit body.

10. The earth-boring bit according to claim 7 wherein a plurality of the wear-resistant elements are secured to the bit body between the threaded end and the shirttail, the majority of the wear-resistant elements being located on the bit body proximal a leading edge of each shirttail.

11. The earth-boring bit according to claim 7 wherein the bit has a gage diameter and the wear-resistant elements project from the bit body an amount less than the gage diameter of the bit.

12. The earth-boring bit according to claim 7 wherein at least a portion of the wear-resistant element is formed of polycrystalline diamond.

13. An earth-boring bit comprising:

a bit body formed of at least one bit section, the bit body being threaded at its upper end for connection to a drill string and having a bit axis of rotation;

at least one bearing shaft depending inwardly and downwardly from each bit section of the bit body, each bit section having a shirttail region proximal the bearing shaft;

a cutter mounted for rotation on each bearing shaft, portions of the bit body and cutters defining a gage diameter of the bit;

a plurality of oblong wear-resistant elements secured to the bit body between the shirttail and the threaded end, each of the oblong wear-resistant elements having an outer side projecting from the bit body by an amount less than the gage diameter of the bit;

each of the oblong wear-resistant elements having an inner side opposite the outer side and a perimeter wall that joins the inner and outer sides, the perimeter wall fitting matingly within an oblong hole formed in the bit body; and the perimeter wall of each of the oblong wear-resistant elements being oblong with two opposite rounded ends through which a long axis which extends in a plane parallel with the inner side, each of the wear-resistant elements being oriented so that its long axis is substantially parallel to the axis of rotation.

14. The earth-boring bit according to claim 13 wherein the bit body includes a shoulder proximal the threaded end and the wear-resistant element is secured to the bit body below the shoulder.

15. The earth-boring bit according to claim 13 wherein the wear-resistant element is formed of hard metal and is secured by interference fit in an aperture in the bit body.

16. The earth-boring bit according to claim 13 wherein at least a portion of the wear-resistant element is formed of polycrystalline diamond.

* * * * *

UNITED STATES PATENT AND TRADEMARK OFFICE

CERTIFICATE OF CORRECTION

PATENT NO. : 6,607,047 B1
DATED : August 19, 2003
INVENTOR(S) : Mohammed Swadi et al.

It is certified that error appears in the above-identified patent and that said Letters Patent is hereby corrected as shown below:

Column 3,
Line 10, delete “33” and insert -- 31 --

Column 6,
Line 12, delete “which” after “axis”

Signed and Sealed this

Thirtieth Day of December, 2003

JAMES E. ROGAN
*Director of the United States Patent and Trademark Office*